US007694912B2

(12) United States Patent
Hatanaka et al.

(10) Patent No.: US 7,694,912 B2
(45) Date of Patent: Apr. 13, 2010

(54) WINDING APPARATUS

(75) Inventors: Masayuki Hatanaka, Kyoto (JP); Hiroshi Kimura, Kyoto (JP); Hirokazu Kano, Kyoto (JP); Takashi Nakamura, Kyoto (JP)

(73) Assignee: Nishimura Seisakustto Co., Ltd., Kyoto (JP)

( * ) Notice: Subject to any disclaimer, the term of this patent is extended or adjusted under 35 U.S.C. 154(b) by 402 days.

(21) Appl. No.: 10/592,626

(22) PCT Filed: Apr. 1, 2004

(86) PCT No.: PCT/JP2004/004797

§ 371 (c)(1),
(2), (4) Date: Aug. 1, 2007

(87) PCT Pub. No.: WO2005/087638

PCT Pub. Date: Sep. 22, 2005

(65) Prior Publication Data

US 2008/0251627 A1 Oct. 16, 2008

(30) Foreign Application Priority Data

Mar. 10, 2004 (JP) ..... 2004-067282

(51) Int. Cl.
*B65H 49/32* (2006.01)

(52) U.S. Cl. ..... 242/599.3; 242/599.4

(58) Field of Classification Search ..... 242/598, 242/599.3–599.4, 599, 599.2
See application file for complete search history.

(56) References Cited

U.S. PATENT DOCUMENTS

| | | | | | |
|---|---|---|---|---|---|
| 1,158,653 | A | | 11/1915 | Dowe | |
| 1,638,889 | A | | 8/1927 | Soderberg | |
| 3,282,524 | A | * | 11/1966 | Couzens et al. | 242/533.2 |
| 3,291,412 | A | * | 12/1966 | Rockstrom et al. | 242/530.4 |
| 3,332,636 | A | * | 7/1967 | Rockstrom et al. | 242/530.4 |
| 3,391,876 | A | | 7/1968 | Dalglish | |
| 3,635,415 | A | | 1/1972 | Phelps et al. | |
| 3,977,617 | A | * | 8/1976 | Salmon | 242/421.2 |
| 4,346,852 | A | * | 8/1982 | Kawada et al. | 242/530.4 |
| 5,110,063 | A | | 5/1992 | Koepe | |
| 5,205,503 | A | * | 4/1993 | Hutzenlaub | 242/530.3 |

FOREIGN PATENT DOCUMENTS

| | | |
|---|---|---|
| DE | 30 40 189 A1 | 5/1981 |
| JP | 62806 | 3/1925 |
| JP | S38-18664 | 9/1963 |
| JP | 57-180346 | 11/1982 |
| JP | S59-30699 | 2/1984 |
| JP | 05-022909 | 1/1993 |
| JP | 09-086733 | 3/1997 |
| JP | 10-290596 | 10/1998 |
| JP | 2000-128462 | 5/2000 |

* cited by examiner

*Primary Examiner*—Sang Kim
(74) *Attorney, Agent, or Firm*—Kirschstein, et al.

(57) ABSTRACT

A novel winding device of special arrangement insusceptible to vibration of a drive motor. A winding roll (2) is supported on a winding arm (1) and combined with a drive motor. The drive motor has a body (3) and a rotary shaft (4) penetrating of the body to project from the opposite sides thereof. Furthermore, a pair of bearings (5) are provided on the winding arm and the rotary shaft is supported rotatably on the opposite sides of the body. A rotation-stop (6) is provided between the winding arm and the body and, in the rotational direction of the rotary shaft, the body is restricted by the rotation-stop and does not rotate. Consequently, a web material can be wound around the winding roll by rotating the winding roll through the drive motor.

2 Claims, 7 Drawing Sheets

WINDING APPARATUS

TECHNICAL FIELD

The invention relates to a winding apparatus for a web material.

BACKGROUND

For example, there has been a slitter for slitting a web material into webs and winding the webs about winding rolls after slitting. In general, the slitter includes winding arms by which the winding rolls are supported, and drive motors provided on the winding arms, the winding rolls being rotated by the drive motors to wind the webs about the winding rolls.

In this case, the drive motor generates a vibration which is transmitted to the winding arm and the winding roll, resulting in harmful effects on winding accuracy. An improvement is desired to overcome the problem.

It is therefore an object of the invention to provide a winding apparatus which can avoid the influence of vibration.

DISCLOSURE OF THE INVENTION

According to the invention, the apparatus includes a winding arm by which a winding roll is supported, and a drive motor including a body and a rotating shaft. The rotating shaft passes through the body to protrude on the opposite sides of the body. A pair of bearings are provided on the winding arm, the rotating shaft being supported for rotation by the bearings on the opposite sides of the body. A restrainer is provided between the winding arm and the body, the body being restrained from being rotated by the restrainer in the rotating direction of the rotating shaft. The winding roll is therefore rotated by the drive motor to wind a web material about the winding roll.

In a preferred embodiment, the drive motor includes a hollow shaft, the rotating shaft being fitted into the hollow shaft. The rotating shaft and the hollow shaft are restrained from being rotated relatively to each other by a key or spline so that the rotating shaft and the hollow shaft can be rotated integrally with each other. The rotating shaft or hollow shaft is connected to the winding roll to make the winding roll rotated.

In the embodiment, a plurality of winding arms are spaced from each other to constitute adjacent pairs. The winding roll is interposed between each of the pairs of winding arms. The drive motor is provided on one or both of each of the pairs of winding arms to make the winding roll rotated.

The drive motors are disposed coaxially to each other so that the rotating shafts can be connected to each other.

The drive motors are disposed for rotation in the same direction.

BEST MODE TO CARRY OUT THE INVENTION

Figure 1:
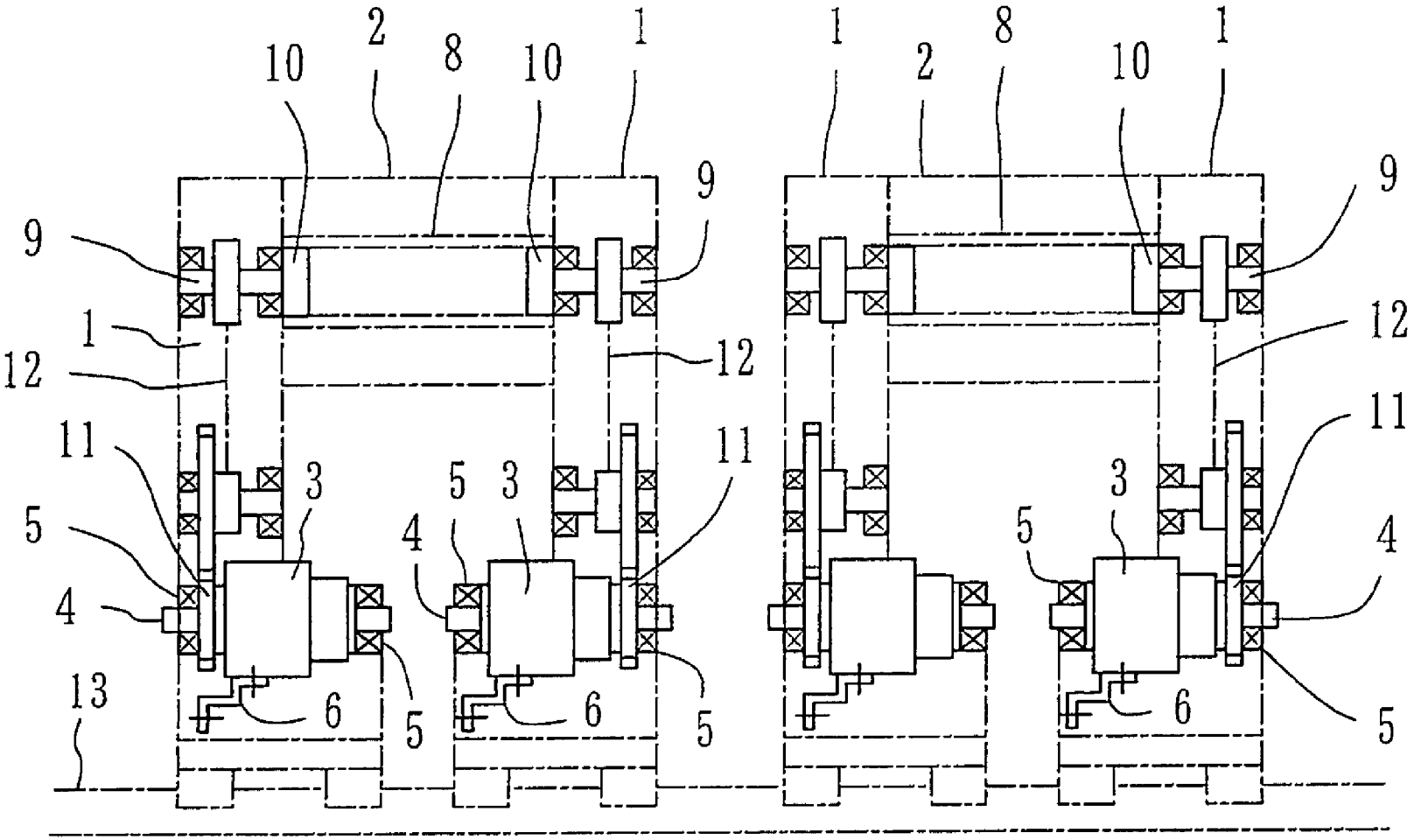
FIG. 1 is an explanatory view of a preferred embodiment of the invention

FIG. 1 illustrates a winding apparatus according to the invention. The apparatus includes a winding arm 1 by which a winding roll 2 is supported, and a drive motor including a body 3 and a rotating shaft 4. The rotating shaft 4 passes through the body 3 to protrude on the opposite sides of the body 3. A pair of bearings 5 are provided on the winding arm 1, the rotating shaft 4 being supported for rotation by the bearings 5 on the opposite sides of the body 3. In addition, a restrainer 6 is interposed between the winding arm 1 and the body 3. The restrainer 6 comprises a metallic peace having opposite ends one of which is mounted on and fixed to the winding arm 1. The other end is mounted on and fixed to the body 3. The body 3 is therefore restrained from being rotated by the restrainer 6 in the rotating direction of the rotating shaft 4.

Figure 2:
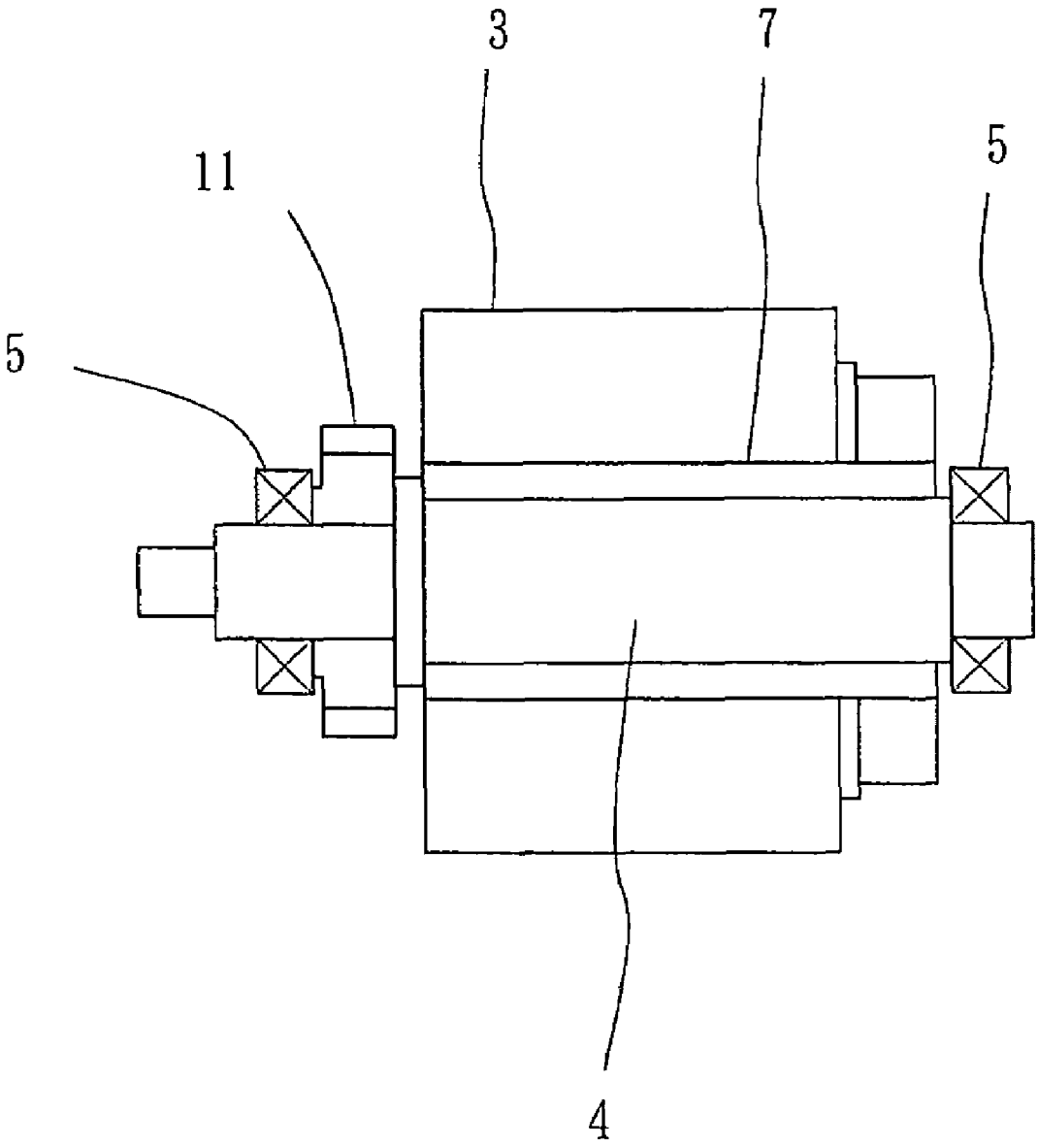
FIG. 2 is a sectional view of the drive motor of the apparatus of FIG. 1

The drive motor further includes a hollow shaft 7, the rotating shaft 4 being fitted into the hollow shaft 7 to protrude on the opposite sides of the body 3, as shown in FIG. 2. The rotating shaft 4 and the hollow shaft 7 are restrained from being rotated relatively to each other by a key or spline so that the rotating shaft 4 and the hollow shaft 7 can be rotated integrally with each other, the rotating shaft 4 being supported for rotation by the bearings 5 on the opposite sides of the body 3. In addition, the rotating shaft 4 or hollow shaft 7 is connected to the winding roll 2 to make the winding roll 2 rotated and wind a web material about the winding roll 2.

The apparatus is used in a slitter in which a plurality of winding arms 1 are spaced from each other to constitute adjacent pairs, the winding roll 2 being interposed between each of the pairs of winding arms 1, as in the case of the apparatus disclosed in Japanese Laid-Open Patent Publication H09-86733. The apparatus is arranged to wind webs about cores 8, forming winding rolls 2, after slitting a web material into the webs, as also in the case of the apparatus disclosed in the publication. The drive motor is provided on one or both of each of the pairs of winding arms 1 to make the core 8 and the winding roll 2 rotated and wind the web material about the winding roll 2. For example, the winding shaft 1 includes a transmission shaft 9 on which a chuck 10 is provided, the core 8 being interposed between each of the pairs of winding arms 1. The core 8 has opposite ends fixed to the chucks 10. The rotating shaft 4 or hollow shaft 7 is connected to the transmission shaft 9 by means of gears 11 and a belt 12. The rotating shaft 4 and the hollow shaft 7 are rotated integrally with each other at a velocity which is reduced by the gears 11 and the belt 12 to make the core 8 and the winding roll 2 rotated.

The apparatus has therefore no problem even if the drive motor has a certain weight and generates a vibration by reason that the weight is received and supported by the bearings 5 by which the rotating shaft 4 is supported. The restrainer 6 merely makes the body 3 restrained so that the weight would not be received by the restrainer 6. The vibration is therefore absorbed by the bearings 5 not to be transmitted to the winding arm 1 and the winding roll 2. Accordingly, the apparatus can wind the web material conveniently to be high in winding accuracy.

It is also preferable that the rotating shaft 4 and the gear 11 can be drawn out of the hollow shaft 7 when being damaged, to be exchanged for new one.

The apparatus is arranged to wind the webs about the winding rolls 2 after slitting the web material into the webs having slit widths which may be changed. In this connection, in the apparatus, the winding arms 1 are moved along rails 13 to be spaced from each other at distances corresponding to the slit widths. The core 8 and the winding roll 2 are then interposed between each of the pairs of winding arms 1 to wind the webs thereabout. The winding rolls have lengths corresponding to the slit widths.

In addition, in the apparatus, the drive motors are disposed coaxially to each other so that the rotating shafts 4 can be connected to each other. Furthermore, the drive motors are disposed for rotation in the same direction. The drive motors are rotated in the same direction with the same torque characteristic.

Figure 3:
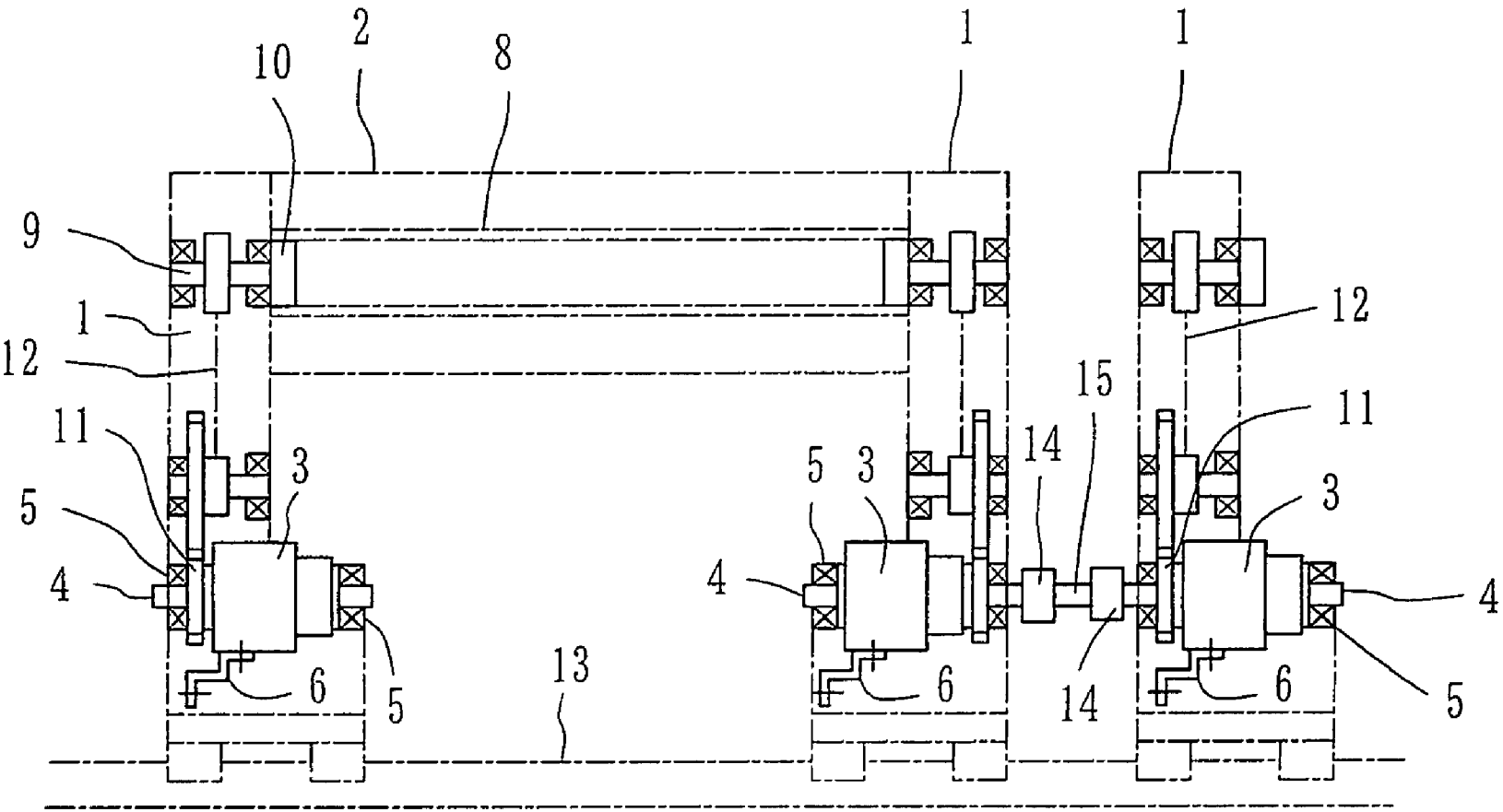
FIG. 3 is an explanatory view of the rotating shafts connected to each other of FIG. 1

Accordingly, in case of long winding roll 2, the winding arms 1 are moved along the rails 13 to be spaced from each other at a distance corresponding to the length of the winding roll 2, as shown in FIG. 3. The core 8 is then fixed to the chucks 10 to make the winding roll 2 supported by the winding arms 1. The drive motors are provided not only on the winding arms 1 by which the winding roll 2 is supported but also on another winding arm 1, the drive motors being disposed coaxially to each other, as described above. The rotating shafts 4 can therefore be connected to each other by means of clutches or couplings 14 and a connecting shaft 15.

The apparatus has therefore no problem even if the winding roll 2 is long by reason that the winding roll 2 can be rotated by the drive motors with a torque being controlled within an increased range. In addition, the drive motors has the same torque characteristic to be controlled in torque without difficulty. Furthermore, the winding roll 2 is rotated with the torque being large while the torque is small when being transmitted from the drive motors by means of the clutches or couplings 14 and the connecting shaft 15 before reduction. The clutches or couplings 14 need not have large capacities.

The slitter includes the winding apparatus disposed in front and in the rear of the slitter, the webs being directed to each of the apparatus after slitting the web material, as disclosed in Japanese Laid-Open Patent Publication H09-86733. In another embodiment of FIG. 4, the front apparatus includes four pairs of winding arms 1 spaced from each other, and the drive motor provided on the left arm 1 of each of the pairs of winding arms 1. The drive motor includes the body 3, the rotating shaft 4 and the hollow shaft, as in the case of the embodiment of FIG. 1. The rotating shaft 4 or hollow shaft is connected to the transmission shaft 9 by means of drive means such as a belt 12. The hollow shaft and the rotating shaft 4 are rotated by the drive motor at a velocity which is reduced by the drive means such as the belt 12 to make the core 8 and the winding roll 8 rotated and wind the web material about the winding roll 2. In addition, a rotating shaft 16 is provided on the right arm 1 and connected to the transmission shaft 9 by means of drive means such as a belt 12. The winding arms 1 can therefore be moved along the rails to make the rotating shaft 4 connected to the rotating shaft 16 by a clutch or coupling 17 so that the core 8 and the winding roll 2 can be rotated by two driving motors between the particular pair of winding arms 1. The rear apparatus has the same structure.

Figure 4:
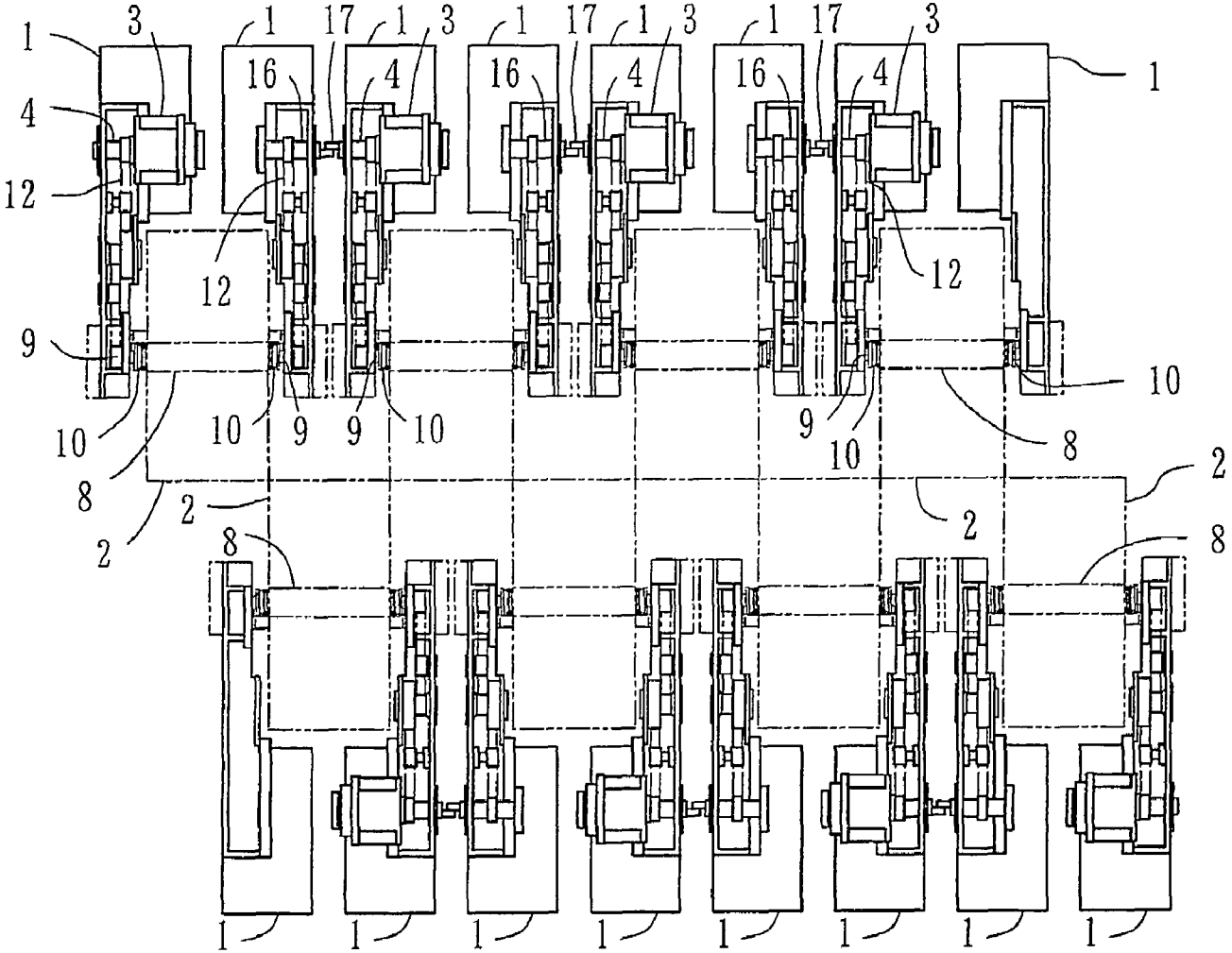
FIG. 4 is an explanatory view of another embodiment
Figure 5:
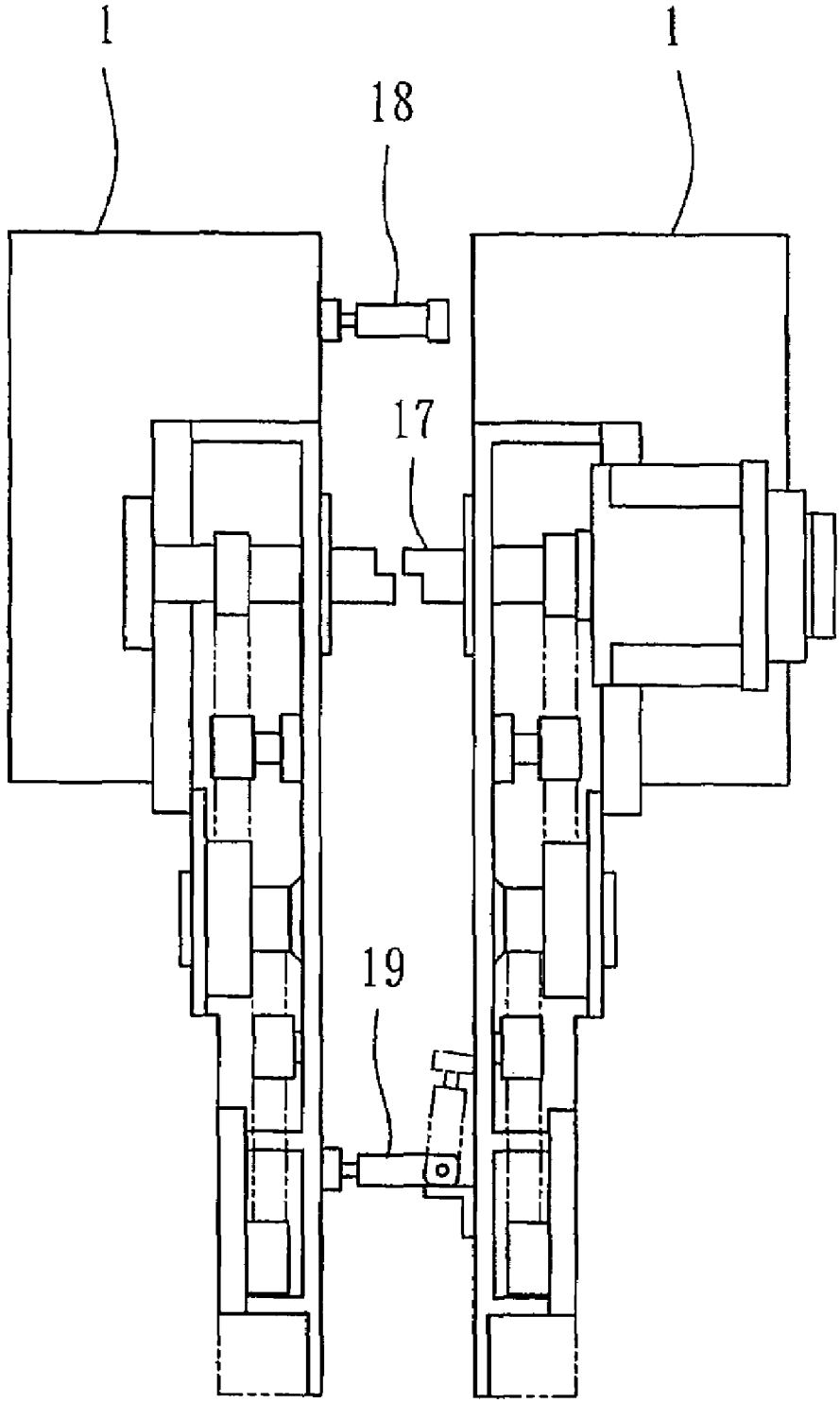
FIG. 5 is an explanatory view of the stop of the apparatus of FIG. 4

In the embodiment of FIG. 4, the winding arms 1 may be stopped by a stop 18 when being moved along the rails so that the rotating shaft 4 can be connected to the rotating shaft 16 by means of the clutch or coupling 17, as shown in FIG. 5. A stop 19 may be stood vertically to make the rotating shaft 4 connected to the rotating shaft 16 by the clutch or coupling 17. The stop 19 should be laid down horizontally to make the winding arm stopped and keep the clutch or coupling 17 being disconnected.

Figure 6:
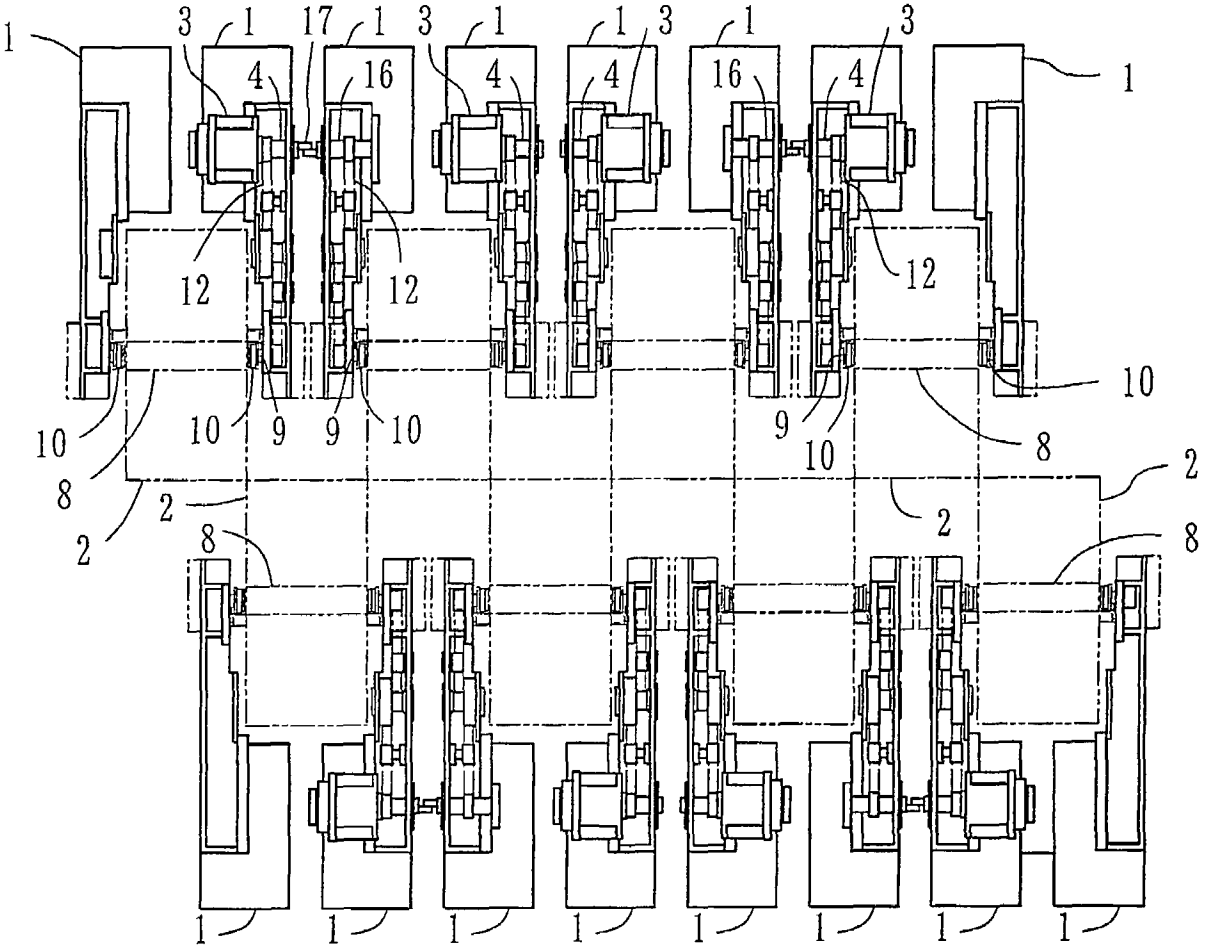
FIG. 6 is an explanatory view of another embodiment

In another embodiment of FIG. 6, the front apparatus includes four pairs of winding arms 1 spaced from each other, the drive motor provided on the right arm 1 of the outer pair of winding arms 1 in the left half, the drive motor provided on the right arm 1 of the inner pair and the rotating shaft 16 provided on the left arm 1 of the inner pair. The front apparatus further includes the drive motor provided on the left arm 1 of the outer pair of winding arms 1 in the right half, the drive motor provided on the left arm 1 of the inner pair and the rotating shaft 16 provided on the right arm 1 of the inner pair. The rotating shaft 4 or hollow shaft is connected to the transmission shaft 9 by means of drive means such as a belt 12, the core 8 and the winding roll 2 being rotated by the drive motor to wind the web material about the winding roll 2. In addition, the rotating shaft 16 is connected to the transmission shaft 9 by means of drive means such as a belt 12, the rotating shaft 4 and the rotating shaft 16 being connected by a clutch or coupling so that the core 8 and the winding roll 2 can be rotated by two motors between the inner pair of winding arms 1. The rear apparatus has the same structure.

Figure 7:
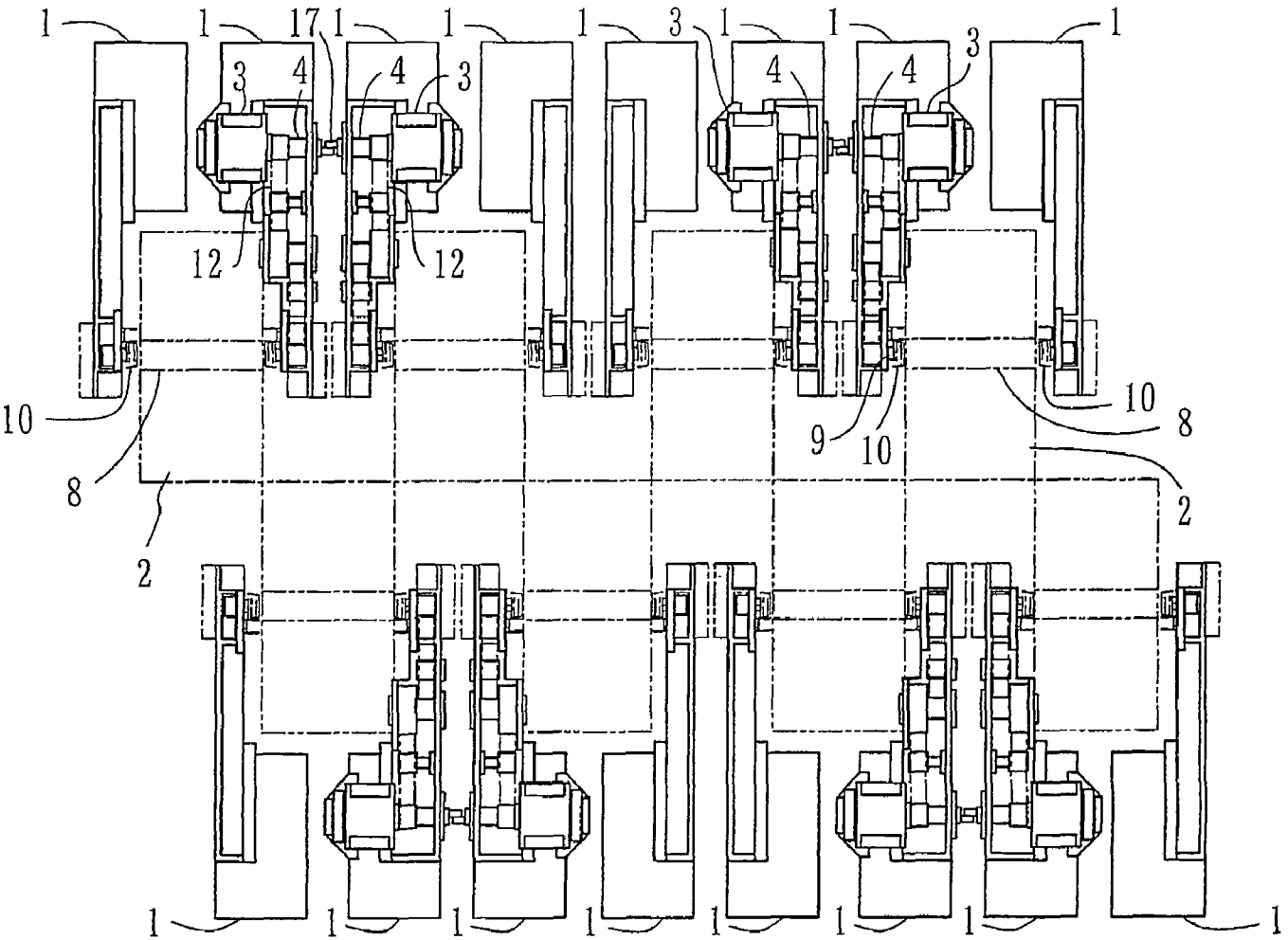
FIG. 7 is an explanatory view of another embodiment

In another embodiment of FIG. 7, the front apparatus includes four pairs of winding arms 1 spaced from each other, the drive motor provided on the right arm 1 of the outer pair of winding arms 1 in the left half and the drive motor provided on the left arm 1 of the inner pair. The front apparatus further includes the drive motor provided on the left arm 1 of the outer pair of winding arms 1 in the right half and the drive motor provided on the right arm 1 of the inner pair. The rotating shaft 4 or hollow shaft is connected to the transmission shaft 9 by means of drive means such as a belt 12 to make the core 8 and the winding roll 2 rotated and wind the web material about the winding roll 2. The rotating shafts 4 may be connected to each other by a clutch or coupling 17 so that the core 8 and the winding roll 2 can be rotated by two motors between the inner or outer pair of winding arms 1. The rear apparatus has the same structure.

The invention claimed is:

1. A winding apparatus used in a slitter in which a plurality of winding arms are spaced from each other to constitute adjacent pairs, a winding roll being interposed between and supported by each of the pairs of winding arms, a drive motor being provided on one or both of each of the pairs of winding arms, the winding rolls being rotated by the drive motors to wind webs about the winding rolls after slitting a web material into the webs, the apparatus comprising:

the drive motor including a body and a rotating shaft, the rotating shaft passing through the body to protrude on opposite sides of the body, the drive motor further including a hollow shaft, the rotating shaft being fitted into the hollow shaft, the rotating shaft and the hollow shaft being restrained from being rotated relatively to each other so that the rotating shaft and the hollow shaft are rotated integrally with each other;

a pair of bearings provided on the winding arm on which the drive motor is provided, the rotating shaft being supported for rotation by the bearings on the opposite sides of the body;

the rotating shaft and the hollow shaft being connected to the winding roll at a predetermined position between the bearings to make the winding roll rotatable; and a restrainer provided between the winding arm and the body, the body being restrained from being rotated by the restrainer in a rotating direction of the rotating shaft; wherein the drive motors are disposed coaxially to each other so that the rotating shafts are connected to each other.

2. The winding apparatus as set forth in claim 1, wherein the drive motors are disposed for rotation in the same direction.

* * * * *